US006848885B1

(12) United States Patent
Maclean

(10) Patent No.: US 6,848,885 B1
(45) Date of Patent: Feb. 1, 2005

(54) METHODS AND APPARATUS FOR FABRICATING GAS TURBINE ENGINES

(75) Inventor: Thomas Maclean, Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/642,719

(22) Filed: Aug. 18, 2003

(51) Int. Cl.[7] ..... F01D 1/00
(52) U.S. Cl. ..... 415/220; 415/115
(58) Field of Search ..... 415/220, 115–116, 415/173.1–173.6, 175–178

(56) References Cited

U.S. PATENT DOCUMENTS 4,840,026 A * 6/1989 Nash et al. ..... 60/770

6,089,821 A * 7/2000 Maguire et al. ..... 415/115

* cited by examiner

*Primary Examiner*—Edward K. Look
*Assistant Examiner*—James M. McAleenan
(74) *Attorney, Agent, or Firm*—William Scott Andes Armstrong Teasdale LLP

(57) ABSTRACT

A method for fabricating a turbine casing including a plurality of turbine shroud assemblies is provided. The method includes providing a base casing having a forward mounting flange and an aft mounting flange and at least one channel defined therebetween, machining a rim on the base casing proximate the at least one channel, and coupling a ring member to the base casing with an interference fit such that the rim is at least partially received within a groove formed within the ring member.

19 Claims, 3 Drawing Sheets

METHODS AND APPARATUS FOR FABRICATING GAS TURBINE ENGINES

BACKGROUND OF THE INVENTION

This invention relates generally to gas turbine engines, and more specifically to turbine casings used with gas turbine engines.

Gas turbine engines generally include, in serial flow arrangement, a high pressure compressor for compressing air flowing through the engine, a combustor in which fuel is mixed with the compressed air and ignited to form a high energy gas stream, and a high pressure turbine. The high pressure compressor, combustor and high pressure turbine are sometimes collectively referred to as the core engine. Such gas turbine engines also may include a low pressure compressor, or booster, for supplying compressed air to the high pressure compressor.

At least some known turbines include a rotor assembly including a plurality of rows of rotor blades. Each rotor blade extends radially outward from a blade platform to a tip. A plurality of shrouds couple together to form a flow path casing that extends substantially circumferentially around the rotor assembly, such that a tip clearance is defined between each respective rotor blade tip and the casing. The tip clearance is designed to be a minimum, while still being sized large enough to facilitate rub-free engine operation through a range of available engine operating conditions.

During operation, turbine performance may be influenced by the tip clearance between turbine blade tips and the shroud. Specifically, as the clearance increases, leakage across the rotor blade tips may adversely limit the performance of the turbine assembly. To facilitate maintaining blade tip clearance at least some known shroud designs attempt to match the rate of thermal expansion of the stator case to the rate of thermal expansion of the turbine rotor assembly by supplying a variable amount of cooling fan air to the casing flanges. Cooling the flanges facilitates controlling thermal movement to facilitate eliminating rocking of the shrouds. The mass at the flange also pushes the casing downward to facilitate maintaining blade tip clearances.

To facilitate the controlling of thermal movement and the maintaining of blade tip clearances, casing members include a pseudo flange which adds structural integrity to the shroud casing.

In some instances, the pseudo flange is hourglass-shaped with a large mass of material formed at its outer diameter and a thin mid section. However, fabricating such pseudo flanges may be both expensive and time consuming.

BRIEF DESCRIPTION OF THE INVENTION

In one aspect, a method for fabricating a turbine casing including a plurality of turbine shroud assemblies is provided. The method includes providing a base casing having a forward mounting flange and an aft mounting flange and at least one channel defined therebetween, machining a rim on the base casing proximate the at least one channel, and coupling a ring member to the base casing with an interference fit, such that the rim is at least partially received within a groove formed within the ring member.

In another aspect, an engine casing assembly for a gas turbine engine is provided. The assembly includes a base casing that includes a forward flange, an aft flange, and a body extending therebetween. The body includes at least one channel defined therein. An annular ring member is coupled to the base casing. The ring member is configured to thermally expand at a rate that is substantially identical to a rate of thermal expansion of the forward and aft flanges.

In another aspect, a gas turbine engine is provided. The engine includes a turbine section including a turbine, and an outer casing assembly circumscribing the turbine. The casing assembly includes a base casing including a forward flange, an aft flange, and a body extending therebetween. The body includes at least one channel defined therein. The casing assembly further includes an annular ring member coupled to the base casing. The ring member is configured to thermally expand at a rate that is substantially identical to a rate of thermal expansion of the forward and aft flanges.

DETAILED DESCRIPTION OF THE INVENTION

Figure 1:
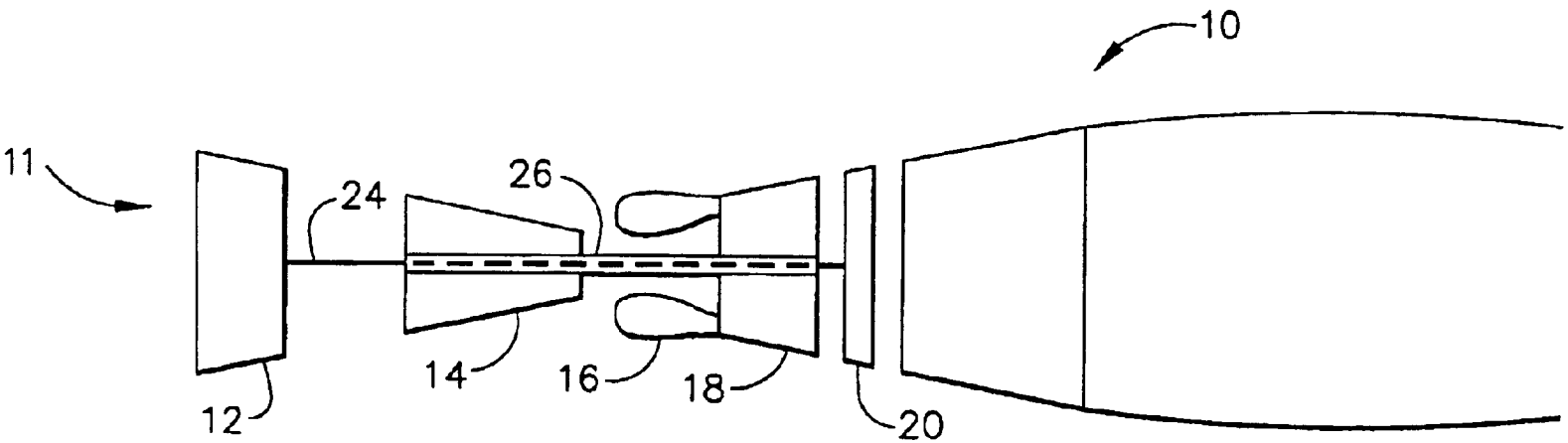
FIG. 1 is a schematic illustration of a gas turbine engine.

FIG. 1 is a schematic illustration of a gas turbine engine 10 including a low pressure compressor 12, a high pressure compressor 14, and a combustor assembly 16. Engine 10 also includes a high pressure turbine 18, and a low pressure turbine 20 arranged in a serial, axial flow relationship. Compressor 12 and turbine 20 are coupled by a first shaft 24, and compressor 14 and turbine 18 are coupled by a second shaft 26. In one embodiment, engine 10 is an GE90 engine commercially available from General Electric Company, Cincinnati, Ohio.

In operation, air flows through low pressure compressor 12 from an upstream side 11 of engine 10 and compressed air is supplied from low pressure compressor 12 to high pressure compressor 14. Compressed air is then delivered to combustor assembly 16 where it is mixed with fuel and ignited. The combustion gases are channeled from combustor 16 to drive turbines 18 and 20.

Figure 2:
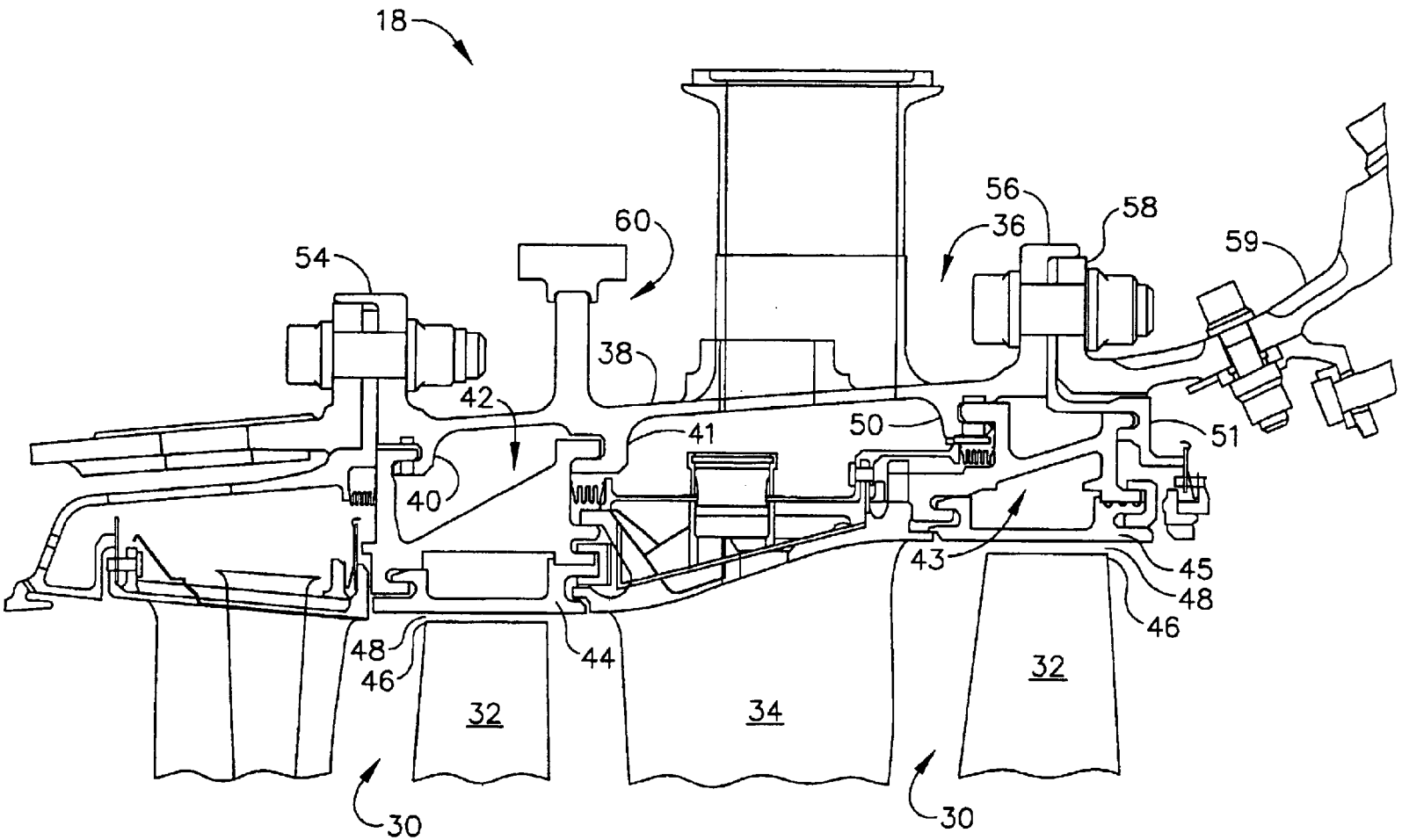
FIG. 2 is a schematic illustration of a portion of a high pressure turbine shown in FIG. 1.
Figure 3:
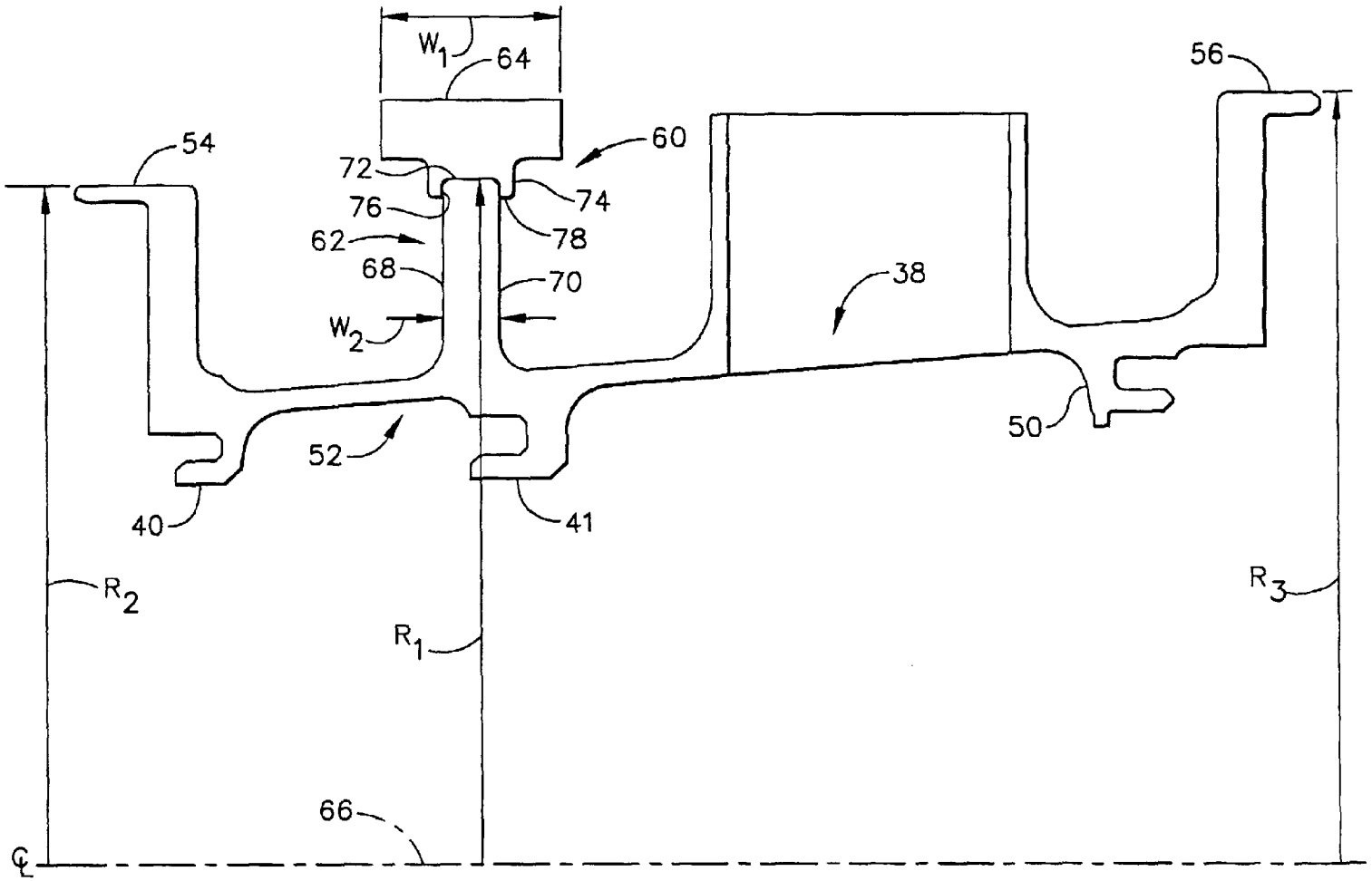
FIG. 3 is an enlarged cross sectional view of a portion of the high pressure turbine shown in FIG. 2.

FIG. 2 is a schematic illustration of a portion of high-pressure turbine 18. FIG. 3 is an enlarged cross sectional view of a portion of high pressure turbine 18. Turbine 18 includes a plurality of stages 30, each of which includes a row of turbine blades 32 and a row of stator vanes 34. Turbine blades 32 are supported by rotor disks (not shown), that are coupled to rotor shaft 26. Stator casing 36 extends circumferentially around turbine blades 32 and stator vanes 34, such that vanes 34 are supported by casing 36.

Casing 36 includes a base case segment 38. Case segment 38 includes a forward mounting hook 40 and an intermediate mounting hook 41. Mounting hooks 40 and 41 define a shroud channel 52 in case segment 38. A forward shroud assembly 42 in shroud channel 52 is coupled to mounting hooks 40 and 41. Case segment 38 also includes an aft mounting hook 50 that is coupled to an adjacent downstream shroud assembly 43. Each shroud assembly 42 and 43 includes a shroud 44 and 45 that are each radially outward of turbine blade tips 46 such that a tip clearance 48 is defined between shrouds 44 and 45 and turbine blade tips 46.

Case segment 38 also includes a forward mounting flange 54 and an aft mounting flange 56 for coupling case segment 38 substantially axially within engine 10. Forward mounting hook 40 extends radially inward from forward mounting flange 54, and aft mounting hook 50 extends radially inward of aft mounting flange 56. A mounting hook 51 is coupled between mounting flange 56 of case segment 38 and a mounting flange 58 extending from an adjacent case segment 59. Thus, shroud assembly mounting hooks 50 and 51 are both positioned at case segment mounting flanges, specifically, mounting flange 56 and mounting flange 58.

A pseudo flange assembly 60 extends from case segment 38 radially opposite intermediate mounting hook 41. Pseudo flange 60 includes a rim 62 and a ring 64 that is coupled to an outer diameter of rim 62. More specifically, rim 62 has a radius $R_1$ measured with respect to an engine center line 66 that is slightly larger than one of a radius $R_2$ of forward case segment mounting flange 54 and a radius $R_3$ of aft mounting flange 56. Rim 62 is defined within base casing 38 radially opposite intermediate mounting hook 41 of shroud assembly 42. In one embodiment, rim 62 is formed via a machining process. In the exemplary embodiment, rim 62 has straight parallel sides 68, 70 to facilitate the machining. However, in alternative embodiments, rim sides 68, 70 are non-parallel.

Ring 64 has a width $W_1$ that is greater than a width $W_2$ of rim 62 and includes a groove 72 defined therein. Grove 72 is sized to receive at least a portion of an outer periphery of rim 62. Ring 64 also includes a lip 74 that circumscribes each side 76, 78 of groove 72 to facilitate inhibiting axial movement between ring 64 and rim 62. In one embodiment, ring 64 is coupled to rim 62 with a shrink fit engagement. Ring 64 is separately machined and can be fabricated in any geometric shape. Ring 64 can also be fabricated from a material different from the case material as long as ring 64 is sized such that the thermal characteristics of ring 64 and rim 62 in combination can be matched to the thermal characteristics of the case segment mounting flanges 54 and 56.

Pseudo flange 60 is formed by machining ring 62 into base case segment 38 at the location of intermediate mounting hook 41 of shroud assembly 42. For ease of machining, rim 62 is machined with generally straight parallel sides. Rim 62 is machined with a radius $R_1$ slightly larger than one of radius $R_2$ of forward mounting flange 54 and radius $R_3$ of aft mounting flange 56 such that rim 62 will have a diameter (not shown) that is also slightly larger than one of a diameter (not shown) of forward mounting flange 54 and a diameter (not shown) of aft mounting flange 56. Ring 64 is machined with a groove 72 sized to receive the outer periphery of rim 62. Ring 64 includes a lip 74 on each side of groove 72 to inhibit any axial movement of ring 64 with respect to rim 62. After fabrication, ring 64 is heated so that it expands sufficiently to pass over one of forward mounting flange 54 and aft mounting flange 56 so that it can be fitted on rim 62. A shrink fit is created as ring 64 cools.

In operation, turbine performance is influenced by tip clearance 48, and as such, it is desired to maintain tip clearance 48 to a designed minimum distance while preventing blade tips 46 from contacting shrouds 44 and 45. In order to optimize and maintain tip clearance 48, it is desired to substantially match the thermal growth of the turbine casing 36, including case segment 38, to that of the rotor disks (not shown) and turbine blades 32. Pseudo flange assembly 60 is provided on base case segment 38 so that thermal growth characteristics of case segment 38 at mounting hooks 40 and 41 for shroud assembly 42 can be matched with the thermal characteristics of forward and rearward case mounting flanges 54 and 56, respectively, so that turbine blade tip to shroud clearance 48 is facilitated to be maintained.

In one embodiment, the thermal expansion matching is facilitated by cooling the casing flanges, including flanges 54 and 56, and pseudo flange assembly 60 with a variable amount of cooling air. In one embodiment, the cooling air is compressor discharge air. The matching of the thermal behavior of pseudo flange assembly 60 to casing flanges 54 and 56 facilitates the avoidance of any rocking of shroud assembly 42 which facilitates preventing contact between shroud assembly 42 and turbine blades 32.

The above-described pseudo flange provides a cost-effective flange that can be used for matching thermal growth characteristics in a case segment so that turbine blade tip to shroud clearances may be maintained. The pseudo flange is of a simplified design that also allows for simplifying the design of bleed ports in the area of the pseudo flange. The pseudo flange also provides for the use of a ring of a different material than that of the casing which may provide a better thermal match due to differing coefficients of thermal expansion between the ring material and the case material.

Exemplary embodiments of turbine casing shrouds are described above in detail. Each shroud casing assembly is not limited to the specific embodiments described herein, but rather each component may be utilized independently and separately from other components described herein. Each component can also be used in combination with other turbine casing shroud assemblies.

While the invention has been described in terms of various specific embodiments, those skilled in the art will recognize that the invention can be practiced with modification within the spirit and scope of the claims.

What is claimed is:

1. A method for fabricating a turbine casing including a plurality of turbine shroud assemblies, said method comprising:

providing a base casing having a forward mounting flange, an aft mounting flange, and at least one channel defined therebetween;

machining a rim on the base casing proximate the at least one channel; and coupling a ring member to the base casing with an interference fit such that the rim is at least partially received within a groove formed within the ring member.

2. A method in accordance with claim 1 wherein machining a rim further comprises machining the rim such that the at least one channel extends substantially between the rim and at least one of the forward and aft mounting flanges.

3. A method in accordance with claim 1 wherein machining a rim further comprises machining the rim such that an outer diameter of the rim is larger than an outer diameter of one of the forward and aft mounting flanges.

4. A method in accordance with claim 1 wherein coupling a ring member to the base casing further comprises forming a lip on each side of the groove to facilitate limiting axial movement of the ring with respect to the rim.

5. A method in accordance with claim 1 wherein coupling a ring member to the base casing further comprises coupling the ring member to the rim with a shrink fit.

6. An engine casing assembly for a gas turbine engine, said assembly comprising:

a base casing comprising a forward flange, an aft flange, and a body extending therebetween, said body comprising at least one channel defined therein; and an annular ring member coupled to said base casing, said ring member configured to thermally expand at a rate that is substantially identical to a rate of thermal expansion of said forward and aft flanges.

7. An assembly in accordance with claim 6 wherein said base casing body further comprises a rim in contact with said body proximate said at least one channel.

8. An assembly in accordance with claim 7 wherein said rim has an outer diameter that is larger than an outer diameter one of said forward and aft flanges.

9. An assembly in accordance with claim 7 wherein said rim is integral with said body.

10. An assembly in accordance with claim 7 wherein said ring member has a width that is wider than a width of said rim, said ring member comprises a groove extending across an inner surface thereof, said groove is sized to receive at least a portion of said rim therein.

11. An assembly in accordance with claim 10 wherein said ring member further comprises a lip extending along each side of said groove, said lip facilitates preventing axial movement of said ring member with respect to said rim.

12. An assembly in accordance with claim 10 wherein said ring member is coupled to said rim with a shrink fit engagement.

13. A gas turbine engine comprising:

a turbine section comprising a turbine; and an outer casing assembly circumscribing said turbine, said casing assembly comprises a base casing comprising a forward flange, an aft flange, and a body extending therebetween, said body comprises at least one channel defined therein, said casing assembly further comprising an annular ring member coupled to said base casing, said ring member is configured to thermally expand at a rate that is substantially identical to a rate of thermal expansion of said forward and aft flanges.

14. An engine in accordance with claim 13 wherein said base casing body further comprises a rim in contact with said body proximate said at least one channel.

15. An engine in accordance with claim 14 wherein said rim has an outer diameter that is larger than an outer diameter of diameter one of said forward and aft flanges.

16. An engine in accordance with claim 14 wherein said rim is integral with said body.

17. An engine in accordance with claim 14 wherein said ring member has a width that is wider than a width of said rim, said ring member comprises a groove defined across an inner surface thereof, said groove is sized to receive at least a portion of said rim therein.

18. An engine in accordance with claim 17 wherein said ring member further comprises a lip extending along each side of said groove, said lip facilitates preventing axial movement of said ring member with respect to said rim.

19. An engine in accordance with claim 17 wherein said ring member is coupled to said rim with a shrink fit engagement.

* * * * *

UNITED STATES PATENT AND TRADEMARK OFFICE

CERTIFICATE OF CORRECTION

PATENT NO. : 6,848,885 B1
DATED : February 1, 2005
INVENTOR(S) : Thomas Maclean

It is certified that error appears in the above-identified patent and that said Letters Patent is hereby corrected as shown below:

Column 6,
Line 10, delete “diameter of diameter” and insert therefor -- diameter of --.

Signed and Sealed this

Twenty-seventh Day of September, 2005

JON W. DUDAS
*Director of the United States Patent and Trademark Office*